United States Patent [19]

Davies et al.

[11] 4,155,882

[45] May 22, 1979

[54] PROCESS FOR PREPARING PARTICULATE DETERGENT COMPOSITIONS CONTAINING NONIONIC SURFACTANTS

[75] Inventors: Richard L. Davies; Christopher C. Storer, both of Wirral, England

[73] Assignee: Lever Brothers Company, New York, N.Y.

[21] Appl. No.: 826,017

[22] Filed: Aug. 19, 1977

Related U.S. Application Data

[63] Continuation of Ser. No. 647,229, Jan. 7, 1976, abandoned, which is a continuation of Ser. No. 429,627, Jul. 29, 1976, abandoned.

[51] Int. Cl.[2] ..... C11D 11/02; C11D 3/30; C11D 3/32

[52] U.S. Cl. ..... 252/548; 252/110; 252/117; 252/525; 252/529; 252/544; 252/DIG. 1

[58] Field of Search ..... 252/89 R, 525, 529, 252/544, 548, 523, 541, DIG. 1

[56] References Cited

U.S. PATENT DOCUMENTS

| | | | |
|---|---|---|---|
| 3,189,551 | 6/1965 | Metcalf et al. | 252/135 |
| 3,403,107 | 9/1968 | Myerly | 252/525 X |
| 3,741,913 | 6/1973 | Waag | 252/544 |
| 3,755,203 | 8/1973 | Bentley et al. | 252/536 |
| 3,801,511 | 4/1974 | Lemoff | 252/135 |
| 3,850,852 | 11/1974 | Neillie et al. | 252/536 |
| 3,853,779 | 12/1974 | Inamorato et al. | 252/110 |

*Primary Examiner*—P. E. Willis, Jr.
*Attorney, Agent, or Firm*—Michael J. Kelly; James J. Farrell; Melvin H. Kurtz

[57] ABSTRACT

A process for preparing a detergent powder containing a nonionic surfactant in which the tendency towards autoxidation is reduced by incorporating into the slurry a relatively large amount of an amino compound such as an alkanolamide, an alkanolamine or an amine, for example coconut monoethanolamide or gelatine.

9 Claims, No Drawings

PROCESS FOR PRODUCING PARTICULATE DETERGENT COMPOSITIONS CONTAINING NONIONIC SURFACTANTS

This is a continuation of application Ser. No. 647,229, filed Jan. 7, 1976, which is a continuation of Ser. No. 429,627, filed July 29, 1976, both abandoned.

This invention relates to a process for use in the production of particulate detergent compositions which as one of the detergent active ingredients contain a nonionic surfactant particularly one of the alkoxylated alcohol or acid type.

Particulate detergent compositions containing nonionic surfactants can be made by the well known spray-drying process. One of the problems which the spray-drying of slurries containing nonionic surfactants introduces is that of stability. Nonionics are less stable at high temperatures in the presence of air than the anionics normally used for preparing spray-dried detergent compositions. In other words nonionics ar liable to undergo autoxidation. The term "autoxidation" is used herein to include the situation in which the substance being spray-dried becomes self-heating owing to contact with oxygen, and is not confined to the situation where the substance undergoes spontaneous combustion. The temperature at which the powder becomes self-heating is referred to as the autoxidation temperature.

We have now discovered that incorporation of a relatively large amount of an amino- or substituted amino-containing compound into the slurry supplied to the spray drying tower has a beneficial effect in elevating the temperature at which autoxidation of the nonionic surfactant occurs.

According to the present invention there is provided a process for producing a particulate detergent composition containing a nonionic surfactant which comprises spray-drying a slurry containing the nonionic surfactant and an amount of an amino or substituted amino compound sufficient for it to comprise at least 4% by weight of the spray-dried powder.

Preferably the slurry contains sufficient of said compound for the resultant particulate detergent composition to contain it in an amount of at least 6% by weight.

The invention also relates to the particulate detergent composition so produced.

Suitable amino- or substituted amino-containing compounds are alkanolamines, such as ethanolamine and long chain alkanolamides, for example palm kernel, tallow and coconut mono and diethanolamides, proteins, for example gelatine, and mixtures thereof. Amides such as acetamide and urea can also be used.

In a modification of the invention, where the amino-containing compound is other than an alkanolamide, for example a material such as hexamine or gelatine, lower levels than 4% can be used.

The problem of autoxidation in the spray-drying tower is pronounced with powders which contain nonionic surfactants having a high content of ethylene oxide or another alkylene oxide. However, the process of this invention is not applicable only to those powders but to ones which contain other nonionic surfactants. Examples of suitable nonionic surfactants are: condensates of alkyl-phenols having an alkyl group (derived, for example, from polymerised propylene, di-isobutylene, octene, dodecene or nonene) containing from about 6 to 12 carbon atoms in either a straight chain or branched chain configuration, with about 5 to 25 moles of ethylene oxide per mole of alkyl-phenol; condensates containing from about 40% to about 80% polyoxyethylene by weight and having a molecular weight of from about 5,000 to about 11,000 resulting from the reaction of ethylene oxide with the reaction product of ethylenediamine and excess propylene oxide, condensates of linear or branched-chain aliphatic alcohols containing from 8 to 18 carbon atoms with ethylene oxide, e.g. a coconut alcohol-ethylene oxide condensate containing about 4 to 30 moles of ethylene oxide per mole of coconut alcohol; long-chain tertiary amine oxides corresponding to the general formula $R_1R_2R_3N \rightarrow O$, wherein $R_1$ is an alkyl radical containing from about 8 to 18 carbon atoms and $R_2$ and $R_3$ are each methyl, ethyl or hydroxy ethyl radicals, such as dimethyl-dodecylamine oxide, dimethyloctylamine oxide, dimethylhexadecylamine oxide and N-bis (hydroxyethyl) dodecylamine oxide; long-chain tertiary phosphine oxide, dimethyltetradecyl-phosphine oxide, ethylmethyl-tetradecylphosphine oxide, dimethylstearylphosphine oxide, ethylpropylcetylphosphine oxide, diethyldodecylphosphine oxide, bis (hydroxymethyl) dodecyl phosphine oxide, bis (2-hydroxyethyl) dodecylphosphine oxide, 2-hydroxypropylmethyltetradecyl-phosphine oxide, dimethyloleylphosphine oxide and dimethyl-2-hydroxydodecyl-phosphine oxide; and dialkyl sulphoxides corresponding to the general formula $RR'S \rightarrow O$, wherein R is an alkyl, alkenyl, beta- or gamma-monohydroxyalkyl radical or an alkyl or beta- or gamma-monohydroxalkyl radical containing one or two other oxygen atoms in the chain, the R groups containing from 10 to 18 carbon atoms and wherein R' is methyl, ethyl or alkylol radical, such as dodecyl methyl sulphoxide, tetradecyl methyl sulphoxide, 3-hydroxytridecyl methyl sulphoxide, 2-hydroxydodecyl methyl sulphoxide, 3-hydroxy-4-dodecyloxybutyl methyl sulphoxide, 2-hydroxy-3-decyloxypropyl methyl sulphoxide, dodecyl ethyl sulphoxide, 2-hydroxydodecyl ethyl sulphoxide and dodecyl-2-hydroxyethyl sulphoxide.

Preferred nonionic surfactants are:

1. Nonyl phenol 8, 10, 12 and 15 (moles) ethylene oxide condensates
2. Tergitol 15-S-7, 9, 12 and 15
3. Tergitol 45-S-7, 9, 10, 12 and 15
4. Dobanol 25-7, 9, 12 and 15
5. Dobanol 45-7, 9, 12 and 15
6. Softanol 70 and 90 (which contain 7 and 9 moles of ethylene oxide respectively)
7. Alfol 12/14 and 14/12-7, 9, 12 and 15
8. Synperonic 7, 9, 11 and 15
9. Acropol 357EO, 359EO and 11EO All of these materials are ethoxylated alcohols. Synperonics (registered trade mark of Imperial Chemical Industries Limited), Dobanols (registered trade mark of Shell Chemicals Limited) and Acropols (registered trade mark of Ugine-Kuhlman) are ethoxylated derivatives of primary alcohols prepared by the Oxo process. These alcohols consequently contain a proportion of branched materials. Alfols (registered trade mark) are derived from Condea-Ziegler alcohols and are therefore less branched. Tergitols (registered trade mark of Union Carbide Corporation) and Softanols (registered trade mark of Japan Catalytic kk) are derived from linear secondary alcohols.

In this specification the term "nonionic surfactant" does not include any alkyl alkanolamides which have detergent activity.

The nonionic surfactants will normally be present in an amount of from about 2 to about 20% by weight when other detergent active compounds, for example soap and/or an anionic detergent, are present, and from about 5 to about 20% by weight of the spray-dried powder when they are the sole detergent active species.

In addition to a nonionic surfactant and an amino- or substituted amino-containing compound the slurry supplied to the spray-drying tower may contain other detergent active compounds, builder materials, anti-redeposition aids, additives to enhance the properties of the slurry and moisture.

One or more builder materials will generally be present in an amount of from about 10 to 80%, preferably 20 to 55% by weight of the spray-dried powder. The builder materials may be phosphate builders such as sodium ortho-, pyro- or tripolyphosphate or mixtures thereof, or they may be other builders, for example sodium carbonate; sodium silicate; sodium citrate; sodium oxydiacetate; sodium nitrilotriacetate; sodium ethylene-diaminetetra-acetate; sodium salts of long-chain dicarboxylic acids, for instance straight chain ($C_{10}$ to $C_{20}$) succinic acids and malonic acids; sodium carboxymethyl oxysuccinate; sodium salts of alpha-sulphonated long-chain monocarboxylic acids; and modified starches such as starches oxidised, for example using sodium hypochlorite, in which some anhydroglucose units have been opened to give dicarboxyl units.

Sodium silicate may also be present as a corrosion inhibitor.

Examples of anti-redeposition agents suitable for use in the process of the invention are sodium carboxymethyl cellulose and copolymers of various ethylenic monomers.

Some or all of the nonionic surfactant, and/or some or all of the amino-or substituted amino-containing compound may be injected into the slurry immediately before spray-drying.

After the slurry has been spray-dried various conventional ingredients of fabric-washing detergent compositions may be added to the resultant powder in conventional amounts by normal post-dosing techniques. Examples of these additional ingredients are lather boosters which can be added by post-dosing in addition to the material incorporated in the slurry in accordance with this invention, inorganic salts such as sodium and magnesium sulphates, chlorine-releasing bleaching agents such as trichloro isocyanurates; oxygen-releasing bleaches such as sodium perborate, and, usually present only in minor amounts, perfumes, colourants, fluorescers, corrosion inhibitors, germicides and enzymes.

The following example shows the effect which an alkanolamide has on the autoxidation temperature of powdered detergent compositions containing a nonionic surfactant. This example is performed with a model system.

EXAMPLE 1

The composition of the system was

| | % by weight |
|---|---|
| *Tergitol-15-S-9 (registered Trade Mark) | 16.5 |
| Sodium tripolyphosphate | 83.5 |

Various amounts of coconut ethanolamide were added to this system and the autoxidation temperatures were determined. The method of determination-consisted of allowing 10 cc per minute of air to percolate through a 7 gram bed of heated powder, the autoxidation temperature being that at which an exotherm was first noted. The results are shown in Table 1.

Table 1

| Weight % Coconut Ethanolamide | Autoxidation Temperature (°C.) |
|---|---|
| 0 | 143 |
| 2 | 158 |
| 4 | 168 |
| 6 | 169 |

EXAMPLE 2

In a further series of experiments the autoxidation temperatures of several spray-dried powder compositions containing various amounts of coconut ethanolamide and nonionic surfactants were determined.

The powder compositions were of the following formula:

| | Parts by weight based on the finished powder |
|---|---|
| Tergitol 15-S-9 | 11.30 |
| Coconut soap | 2.00 |
| Alkaline silicate | 5.00 |
| Sodium tripolyphosphate | 35.00 |
| Sodium carboxymethyl cellulose | 0.50 |
| Moisture etc. | 10.25 |
| Coconut ethanolamide | 0.00, 2.00, 5.00 |

Tergitol 15-S-9 is a linear secondary $C_{11-15}$ alcohol-/ethylene oxide condensate containing 9 moles of ethylene oxide per mole of alcohol supplied by Union Carbide Corporation.

The autoxidation temperatures were determined using 10 gram samples of the powder composition fully fluidised with hot air. The results are shown in Table 2.

Table 2

| Weight % Coconut Ethanolamide | Weight % Tergitol 15-S-9 | Autoxidation Temperature °C. |
|---|---|---|
| 0 | 17.6 | 145 |
| 3.0 | 17.1 | 170 |
| 7.2 | 16.4 | 215 |

The above percentages are expressed as a proportion of the spray-dried powder.

The results in Tables 1 and 2 above clearly demonstrate the effect which coconut ethanolamide has in increasing the autoxidation temperature of nonionic-containing powders.

EXAMPLE 3

In another series of experiments a number of different amino- and substituted amino-containing compounds were examined for the effect which they have on the autoxidation temperature of powder containing Tergitol-15-S-9. The powder contained 16.5% by weight of Tergitol 15-S-9 and 4% by weight of the amino compound, the balance being sodium tripolyphosphate. The compounds used and the autoxidation temperatures achieved were as shown in Table 3.

Table 3

| Amino- or substituted amino compound | Autoxidation Temperature °C. |
|---|---|
| — | 143 |
| Ethanolamine | 157 |
| Acetamide | 150 |
| Urea | 155 |
| Biuret | 150 |
| Coconut monoethanolamide/3EO | 162 |
| Coconut monoethanolamide/10EO | 156 |
| Caprylic diethanolamide | 160 |
| Capric monoethanolamide | 145 |
| Capric diethanolamide | 165 |
| Lauric diethanolamide | 175 |
| Tallow monoethanolamide | 165 |

EXAMPLE 4

The effect of coconut monoethanolamide (CEA) and lauric diethanolamide (LDEA) on the stability of powders containing Tergitol 15-S-9 towards autoxidation has also been investigated in the following series of experiments. Spray-dried base powders containing varying amounts of Tergitol and alkanolamide were examined for heat-stability using a modified form of the Bowes test developed by the Joint Fire Research Organisation at Boreham Wood, Hertfordshire, England and described by P. C. Bowes and A. Cameron in the Journal of Applied Chemical Biotechnology, 1971. In our test the powder is placed in a wire-mesh cube of 10 cm side and is suspended in an oven fitted with a circulating fan and maintained at a fixed temperature, in this case 150° C. The time taken until autoxidation begins to occur is then determined. The results are shown in Tables 4 and 5.

Table 4

| Parts nonionic surfactant in powder | Parts CEA in powder | Time to autoxidation (hr.) |
|---|---|---|
| 16.2 | — | 3.6 |
| 16.2 | 2.25 | 6.2 |
| 16.2 | 6.0 | 25.0 |
| 16.2 | 9.0 | >88.0 |
| 17.1 | 3.0 | 7.7 |
| 17.1 | 9.0 | >88.0 |

Table 5

| Parts nonionic surfactant in powder | Parts CEA in powder | Parts LDEA in powder | Time to autoxidation (hr.) |
|---|---|---|---|
| 16.2 | — | — | 3.6 |
| 16.2 | 2.25 | 1.5 | 16.9 |
| 16.2 | | 4.5 | 38.7 |
| 16.2 | 6.0 | — | 25.0 |

EXAMPLE 5

To a detergent powder having the following formulation:

| | % by weight |
|---|---|
| Tergitol 15-S-9 | 16.2 |
| Coconut soap | 3.0 |
| Sodium triphosphate | 54.0 |
| Sodium alkaline silicate | 7.6 |
| Water and minor ingredients | to 97.75 |

was added 2.25% of one of the amino- or substituted amino-containing compounds shown in Table 6. The resultant powder was heated until autoxidation occurred as described in Example 4.

Table 6

| Material | Autoxidation Time (hours) |
|---|---|
| Lauric monoethanolamide | 8½ |
| Coconut diethanolamide | 7–9½ |
| Coconut propanolamide | 15 |
| Acetic ethanolamide | 10 |
| Hexamine | 7 |
| Gelatine | 8½ |
| Diethanolamine | 5 |
| None | 3 |

What is claimed is:

1. In a process for the production of spray dried particles of a detergent composition containing from about 5 to about 20% by weight of an alkoxylated alcohol nonionic surfactant the process comprising the steps of
   (a) forming an aqueous slurry comprising said nonionic surfactant and other conventional detergent ingredients, and
   (b) spray drying said slurry to form said particles, the improvement which comprises incorporating into said slurry a compound selected from the group consisting of a lower alkyl monoalkanolamine, a lower alkyl alkanolamide of a fatty acid, hexamine, gelatine, or a mixture thereof in an amount such that said compound constitutes at least 4% by weight of said spray dried particles.

2. The process according to claim 1, wherein said amount of said compound present in said slurry is such that it constitutes at least 6% by weight of said spray dried particles obtained therefrom.

3. In a process according to claim 2, the further improvement wherein said compound is incorporated into said slurry by injection under pressure immediately before said spray drying step.

4. The process according to claim 1, wherein said compound is a lower alkanolamide of a fatty acid.

5. The process according to claim 1, wherein said alkanolamide comprises coconut monoethanolamide, lauric monoethanolamide or a mixture thereof.

6. In a process for the production of spray dried particles of a detergent composition containing from about 5 to about 20% by weight of an alkoxylated alcohol nonionic surfactant the process comprising the steps of
   (a) forming an aqueous slurry comprising the nonionic surfactant and other conventional detergent ingredients, and
   (b) spray drying it to form particles, the improvement which comprises incorporating gelatin into the slurry by injection under pressure immediately before said spray drying step in an amount such that it constitutes at least 4% by weight of the spray dried particles.

7. A process for producing spray dried particles of a detergent composition containing from about 5 to 20% by weight of an alkoxylated alcohol nonionic surfactant comprising the steps of forming an aqueous slurry comprising the nonionic surfactant and spray drying it to form particles wherein the improvement comprises incorporating into the slurry at least 4% by weight of the spray dried particles of a lower alkyl monoalkanolamine.

8. A process for producing spray dried particles of detergent composition containing from about 5 to about 20% by weight of an alkoxylated alcohol nonionic surfactant comprising the steps of forming an aqueous slurry comprising the nonionic surfactant and spray drying it to form particles wherein the improvement comprises incorporating into the slurry at least 4% by weight of the spray dried particles of hexamine.

9. A process for producing spray dried particles of a detergent composition containing from about 5 to about 20% by weight of an alkoxylated alcohol nonionic surfactant comprising the steps of forming an aqueous slurry comprising the nonionic surfactant and spray drying it to form particles wherein the improvement comprises incorporating into the slurry at least 4% by weight of the spray dried particles of gelatine.

* * * * *

UNITED STATES PATENT AND TRADEMARK OFFICE

CERTIFICATE OF CORRECTION

PATENT NO. : 4,155,882

DATED : May 22, 1979

INVENTOR(S) : Davies et al.

It is certified that error appears in the above-identified patent and that said Letters Patent are hereby corrected as shown below:

In the title page:

Under "Related U.S. Application Data"
change "Ser. No. 429,627, Jul. 29, 1976," to read
-- Ser. No. 492,627, Jul. 29, 1974, --

Following the data on related U.S. Applications, add the following:

-- Foreign Application Priority Data
Aug. 1, 1973 [GB] United Kingdom..... 36593/73 --.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*